United States Patent [19]

Franck et al.

[11] 4,408,797

[45] Oct. 11, 1983

[54] FURNITURE ARTICLE WITH PADDING ATTACHED TO A SUPPORTING SHELL

[75] Inventors: Klaus Franck, Hanover; Werner Sauer, Wennigsen; Herbert L. Wiesmann, Hameln, all of Fed. Rep. of Germany

[73] Assignee: Wilkhahn, Wilkening & Hahne GmbH & Co., Fed. Rep. of Germany

[21] Appl. No.: 232,861

[22] Filed: Feb. 9, 1981

[30] Foreign Application Priority Data

Feb. 8, 1980 [DE] Fed. Rep. of Germany ..... 3004585

[51] Int. Cl.[3] ..... A47C 31/02

[52] U.S. Cl. ..... 297/218; 297/452

[58] Field of Search ..... 297/218, 219, 441, 452; 5/471

[56] References Cited

U.S. PATENT DOCUMENTS

| | | | |
|---|---|---|---|
| 2,099,200 | 11/1937 | Findora . | |
| 3,001,824 | 9/1961 | Wiener . | |
| 3,082,038 | 3/1963 | Sanderson . | |
| 3,139,308 | 6/1964 | Hershberger et al. . | |
| 3,273,178 | 9/1966 | Baruth et al. . | |
| 3,556,594 | 1/1971 | Anderson | 297/452 |
| 3,722,954 | 3/1973 | Rey et al. | 297/452 |
| 3,904,242 | 9/1975 | Koepke et al. | 297/452 |

FOREIGN PATENT DOCUMENTS

| | | | |
|---|---|---|---|
| 2224000 | 8/1973 | Fed. Rep. of Germany | 297/218 |
| 1201822 | 1/1960 | France . | |
| 317481 | 11/1969 | Sweden | 297/218 |
| 526289 | 9/1972 | Switzerland . | |
| 895911 | 5/1962 | United Kingdom . | |

*Primary Examiner*—William E. Lyddane

*Attorney, Agent, or Firm*—Antonelli, Terry & Wands

[57] ABSTRACT

A sitting furniture article with padding mounted on a supporting shell. The padding includes a cover and a profile strip for clamping the cover to a rim of the shell. The profile strip is embedded along an outer surface thereof in a foam cushion member forming the padding and is surrounded by a tightened cover.

20 Claims, 5 Drawing Figures

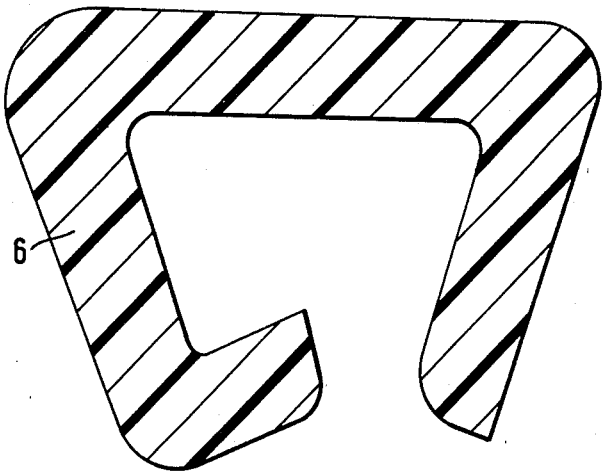
FIG. 3
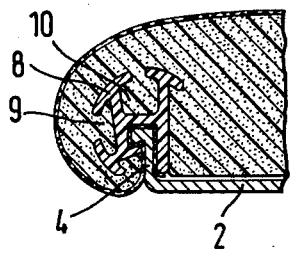
FIG. 4
FIG. 5
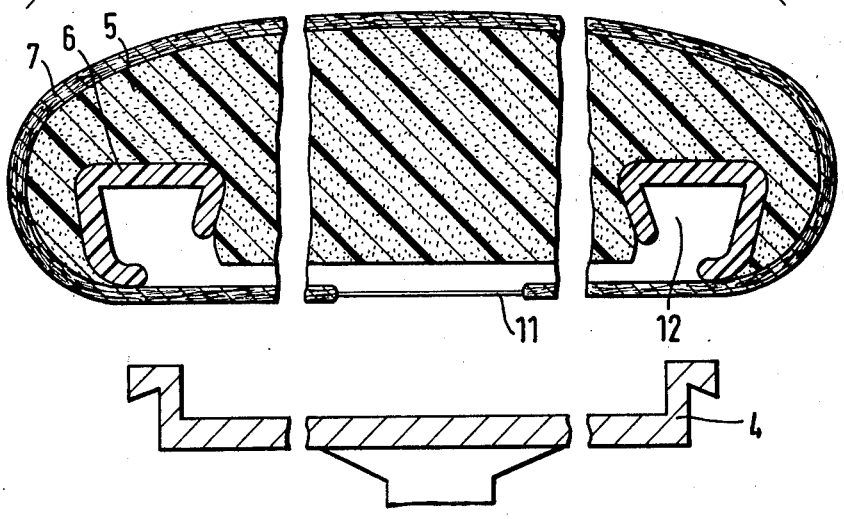

FURNITURE ARTICLE WITH PADDING ATTACHED TO A SUPPORTING SHELL

The present invention relates to a furniture article and, more particularly, to an article of furniture for sitting, with padding attached to a supporting shell, which padding consists of a foam cushion member, a cover, and a profiled strip of material for clamping the cover to a rim of the shell.

In proposed supporting shells of the aforementioned type for furniture designed for sitting which is provided with seat cushions and optionally also back cushions, a foam cushion member is placed on the supporting shell and thereafter the cover or upholstery is pulled around the cushion member and the rim of the supporting shell, with the cover then being clamped together with the shell rim by way of a continuous profile strip such as, for example, a U-shaped profile strip.

One disadvantage of the proposed supporting shells reside in the fact that assemblying operations which must be performed are relatively complicated and generally can only be executed by a manufacturer or an upholsterer. Thus, if the cover, foam member, or merely the profile strip is damaged, the customer is generally no longer able to exchange the padding even if the manufacturer provides the parts for new upholstery.

The aim underlying the present invention essentially resides in providing an article of sitting furniture which includes a padding constructed in such a manner that the padding may be mounted with a few simple manipulations and may readily be replaced later on by a customer after obtaining a corresponding replacement part.

In accordance with advantageous features of the present invention, the profile strip is provided which is embedded along its outer surfaces in a foam cushion member and the cover is tightened thereover.

By virtue of the embedding of the profile strip in the foam cushion member, decisive advantages are attained with respect to assembly and/or exchangeability of the upholstery. For example, by virtue of the feature of the embedding of the profile strip, it is possible to reduce the number of parts to be connected by assemblying from previously four to three parts, namely, a cover, a foam cushion member-profile strip unit, and a shell.

A further advantage of the present invention resides in the fact that the foam cushion member holds the integrated profile strip during assembly in the correct alignment of the shell rim so that the parts to be joined can be placed one on top of the other all at once along their entire connecting edges. Advantageously, the cover in the construction of the present invention may be placed with a certain resiliency around the foam cushion member and the profile strip together. During a subsequent pressing of the profile strip onto the shell rim, the cover experiences an all around definite additional tensioning.

By virtue of the features of the present invention, it is possible for the manufacturer to supply the cover, the foam cushion member, and the profile strip as a quasi one piece spare part which merely needs to be clipped onto the supporting shell for replacement purposes.

In accordance with further advantageous features of the present invention, the shell rim is provided with a bead-shaped, Z-shaped or T-shaped profile, with the profile strip having a groove closely conforming to the profile of the shell rim for clamping the cover in place.

Advantageously, the profile of the profile strip may have one or two additional undercut grooves filled with a foam material of the cushion member. By virtue of this profiling, an especially firm embedding of the profile strip in the foam cushion member is ensured.

Since the profile strip may generally consist of a synthetic resin, it is possible to ensure an intimate and tight bond between the foam of the cushion member and the profile strip by incorporating the profile strip, during a foaming process of the cushion member, into the foam cushion member. Such action results in a solid insertion of the profile strip in the foam of the cushion member.

It is also possible in accordance with the present invention, to produce a foam cushion member with a mounting profile for accommodating the profile strip. Advantageously, the profile strip may be firmly accommodated in the mounting profile by, for example, gluing or by the use of mounting clips or fasteners.

Accordingly, it is an object of the present invention to provide a sitting furniture article which avoids, by simple means, shortcomings and disadvantages encountered in the prior art.

Another object of the present invention resides in providing a sitting furniture article which enables a simple repair and/or replacement of components thereof by a customer.

Another object of the present invention resides in providing a sitting furniture article which is simple in construction and therefore relatively inexpensive to manufacture.

A further object of the present invention resides in providing a sitting furniture article which may readily be assembled without requiring special tools and/or complicated assembly procedures.

These and other objects, features, and advantages of the present invention will become more apparent from the following description when taken in connection with the accompanying drawings which show, for the purpose of illustration only, several embodiments in accordance with the present invention, and wherein:

FIG. 3 is a cross sectional view of a profile strip constructed in accordance with the present invention;

FIG. 4 is another embodiment of a profile strip constructed in accordance with the present invention; and FIG. 5 is an exploded view of a seat surface padding constructed in accordance with the present invention prior to mounting on a shell rim of the article of furniture.

Figure 1:
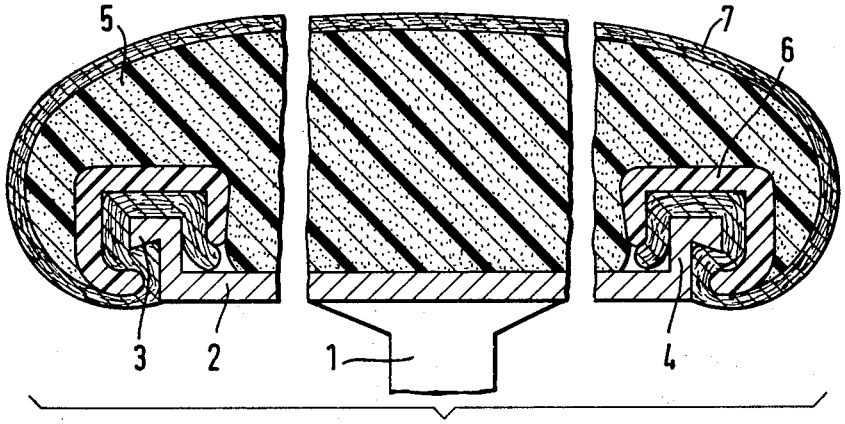
FIG. 1 is a cross sectional view through a seat portion of an article of sitting furniture in accordance with the present invention.

Referring now to the drawings wherein like reference numerals are used throughout the various views to designate like parts and, more particularly, to FIG. 1, according to this figure, a seat shell 2 is held by a supporting leg 1. The seat shell 2 includes a shell rim 4 which, in the illustrated embodiment, is bent upwardly and outwardly so as to form a substantially Z-shape. The continuous shell rim 4 having the Z-shaped profile includes an outwardly bent rim leg 3 which is thickened in wedge shape toward the outside. A foam cushion member 5 is disposed on the seat shell 2. A continuously all around extending profile strip 6 is embedded in the foam cushion member 5. The profile strip 6 has an approximately C-shaped profile and is adapted to be placed on the shell rim 4. As shown in FIG. 1, a cover 7 is clamped between the profile strip 7 and the shell rim 4. The cover 6 is clamped all around the shell rim 4 and is pinched off into folds several times at sharp angles or at right angles between the closely adapted C-shaped profile and Z-shaped profile of the profile strip 6 and continuous shell rim 4, respectively.

Figure 2:
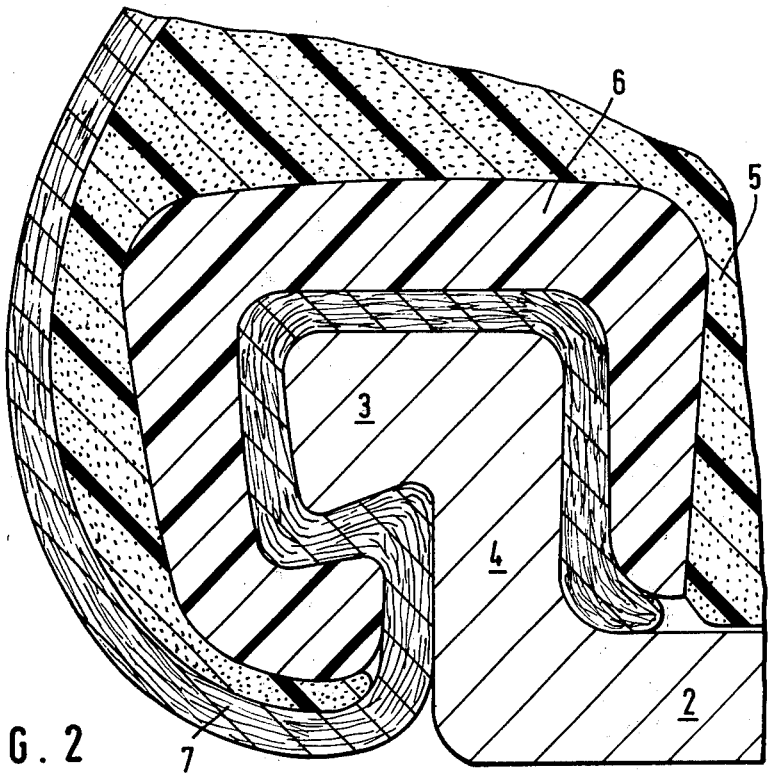
FIG. 2 is an enlarged cross sectional detailed view of a marginal zone of a padded seat surface of the article of FIG. 1.

As shown in FIG. 2, the profile strip 6 is surrounded on its entire outside, except for its internal groove, by a foam material of the foam cushion member 5 so that a firm cohesion is provided between the profile strip 6 and foam cushion member 5 is ensured.

Rather than provide a profile strip 6 having, as shown most clearly in FIG. 3, a substantially C-shaped profile, it is also possible, as shown in FIG. 4, to provide a profile strip 8 having an approximately H-shaped profile which, in addition to an undercut mounting groove for receiving the Z-shaped shell rim 4, also includes further undercut grooves 9, 10 which are filled with the foam material of the foam cushion member.

FIG. 5 provides an illustration of the exchangeability feature of the seat part or seat padding in accordance with the present invention. More particularly, as shown in FIG. 5, the foam cushion member 5 with embedded profile strips 6 may be manufactured at the integral unit and form an exchangeable part. The exchangeable part formed by the foam cushion member 5 and profile strip 6 may, if desired, be provided at the manufacturing plant with the desired cover 7. For this purpose, in order to ensure the maintenance of the cover 7 on the foam cushion 5, several elastic cords 11, strings, or the like may be provided to temporarily gather the cover 7 on the underside of the foam cushion member 5.

To mount the exchangeable or replacement part formed by the foam cushion 5 and embedded profile strip 6, the part is placed along the profile strip 6 on the continuous rim 4 of the shell and then pressed in place by a snap action, during which step the cover 7 experiences a definite additional tensioning by being pressed into the profile strip groove 12 of the profile strip 6.

In lieu of providing a preliminary gathering action by the use of elastic cords 11, string, or the like, the cover 7 may also be tightly clamped to the exchangeable or replacement part of the seat cushion 5 and profile strip 6 in the final form by, for example, utilizing a profile strip which is equipped with a retaining lip arranged in the interior, which lip would then secure a pressed-in-place cover against slipping out.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. An article of furniture comprising a supporting means and a padding means adapted to be mounted on the supporting means, characterized in that the padding means includes a cushion member, a cover means for covering the cushion member, and a profile means having an outer surface embedded in the cushion member for clamping the padding means and cover means directly to the supporting means whereby the padding means and cover means are clamped to the supporting means by said profile means without additional retaining means.

2. An article of furniture according to claim 1, characterized in that the supporting means includes a supporting shell having a shell rim, and in that the cover means tightly surrounds a portion of the profile means.

3. An article of furniture according to claim 2, characterized in that the profile means is a profile strip having a groove means narrowly adapted to the shell rim for enabling a clamping of the cover means to the supporting means.

4. An article of furniture according to claim 3, characterized in that the shell rim has a substantially Z-shaped profile.

5. An article of furniture according to claim 3, characterized in that the shell rim has a substantially T-shaped profile.

6. An article of furniture according to one of claims 3, 4, or 5, characterized in that the profile strip is provided with two undercut grooves for accommodating material of the cushion member.

7. An article of furniture according to claim 6, characterized in that the material of the cushion member is foam material.

8. An article of furniture according to claim 7, characterized in that the profile strip is firmly incorporated in the foam material during a foaming step of the cushion member.

9. An article of furniture according to claim 7, characterized in that means are provided for attaching the profile strip to the cushion member.

10. An article of furniture according to claim 9, characterized in that the attaching means includes clip members.

11. An article of furniture according to claim 7, characterized in that the profile strip is glued to the cushion member.

12. An article of furniture according to claim 7, characterized in that the furniture article is a seat portion.

13. An article of furniture according to one of claims 1, or 2, characterized in that the profile strip has a substantially C-shaped cross sectional configuration.

14. An article of furniture according to claim 13, characterized in that said supporting means terminates in a radially upwardly extending rim portion adapted to be received within a portion of the substantially C-shaped profile strip with at least a portion of the cover means interposed between the rim portion and profile strip to securely clamp the cover means to the supporting means.

15. An article of furniture according to claim 1, characterized in that said profile means defines a groove means opening in a direction of the supporting means, said supporting means terminates in a first upwardly extending portion and a second radially extending portion so as to define a tortuous path for the cover means in the groove means of the profile means.

16. An article of furniture according to claim 1, characterized in that said cushion means surrounds at least three outer surfaces of said profile means.

17. An article of furniture according to claim 1, characterized in that said supporting means and said profile means are configured so as to define a tortuous path for the cover means whereby the cover means is positively clamped between the supporting means and said profile means.

18. An article of furniture according to claim 1, characterized in that said supporting means is formed as a rigid shell member terminating in a rim portion cooperable with said profile means to clamp the padding means and cover means to said supporting means.

19. An article of furniture according to claim 18, characterized in that said profile means is disposed on an underside of said padding means and includes a downwardly extending groove means for accommodating said rim portion and said cover means.

20. An article of furniture according to claim 1, characterized in that said profile means has a substantially H-shaped cross-sectional configuration provided with two undercut groove means for receiving the cushion member and a further groove means for accommodating a portion of the supporting means and the cover means so as to clamp the cover means and padding means to said supporting means.

* * * * *